US006736734B1

(12) United States Patent
Bernhardt

(10) Patent No.: US 6,736,734 B1
(45) Date of Patent: May 18, 2004

(54) BOWLING BALL FINGER GRIP

(76) Inventor: David A. Bernhardt, 4921 Deer Creek Cir. South, Washington Township, MI (US) 48094

( * ) Notice: Subject to any disclaimer, the term of this patent is extended or adjusted under 35 U.S.C. 154(b) by 0 days.

(21) Appl. No.: 09/378,051

(22) Filed: Aug. 20, 1999

(51) Int. Cl.[7] ..... A63B 43/02
(52) U.S. Cl. ..... 473/128; 473/130
(58) Field of Search ..... 473/127, 128, 473/129, 130

(56) References Cited

U.S. PATENT DOCUMENTS

| | | | | |
|---|---|---|---|---|
| 189,674 | A | | 4/1877 | Woods |
| 447,011 | A | | 2/1891 | Harman |
| 580,207 | A | | 4/1897 | Boemermann et al. |
| 626,584 | A | | 6/1899 | Wilmerling |
| 673,688 | A | | 5/1901 | Pickett |
| 950,838 | A | | 3/1910 | Cavanagh |
| 1,021,490 | A | | 3/1912 | Scully |
| 2,273,199 | A | | 2/1942 | Hilton et al. |
| 2,274,522 | A | | 2/1942 | Bomze |
| 2,347,881 | A | | 5/1944 | Chen |
| 2,460,385 | A | | 2/1949 | Hausman |
| 2,485,471 | A | | 10/1949 | Bates |
| 2,539,918 | A | | 1/1951 | McLaren |
| 2,566,511 | A | | 9/1951 | Bassi |
| 2,646,985 | A | | 7/1953 | Nagy et al. |
| 2,708,578 | A | | 5/1955 | Mitchell |
| 2,843,382 | A | | 7/1958 | Ross |
| 2,844,375 | A | | 7/1958 | Nestor |
| 2,973,205 | A | * | 2/1961 | Mitchell ..... 473/130 |
| 2,991,079 | A | | 7/1961 | Yettito |
| 3,078,097 | A | | 2/1963 | Mitchell |
| 3,774,909 | A | | 11/1973 | Linden |
| 3,784,198 | A | | 1/1974 | Bach |
| 3,804,412 | A | | 4/1974 | Chetirko |
| 4,247,102 | A | | 1/1981 | Seyler |
| 4,289,312 | A | | 9/1981 | Heimbigner |
| 4,358,112 | A | | 11/1982 | Straborny |
| 4,381,863 | A | | 5/1983 | Norman |
| 4,416,452 | A | | 11/1983 | Heimbigner |
| 4,432,546 | A | | 2/1984 | Allen, Jr. |
| 4,530,502 | A | | 7/1985 | Yamane |
| 4,560,162 | A | | 12/1985 | Miller |
| 4,561,654 | A | | 12/1985 | Haza |
| 4,569,520 | A | | 2/1986 | Yamane |
| 4,585,230 | A | | 4/1986 | Martin |
| 4,623,149 | A | | 11/1986 | Herman |
| 4,632,396 | A | | 12/1986 | Taylor |
| 4,699,380 | A | | 10/1987 | Mace |
| 4,773,645 | A | | 9/1988 | Todd et al. |
| 4,778,178 | A | | 10/1988 | Haza |
| 5,002,276 | A | | 3/1991 | Bernhardt |
| 5,007,640 | A | | 4/1991 | Bernhardt |
| 5,118,106 | A | | 6/1992 | Goldman |
| 5,123,644 | A | | 6/1992 | Bernhardt |
| 5,176,378 | A | | 1/1993 | Bernhardt |
| 5,308,061 | A | * | 5/1994 | Bernhardt ..... 473/127 |

OTHER PUBLICATIONS

Advertisement by Pro Sports Systems, Inc. entitled, "Manufacturers of the Grips that Legends Use", Publication Date Unknown.

* cited by examiner

*Primary Examiner*—William M. Pierce
(74) *Attorney, Agent, or Firm*—Harness, Dickey & Pierce, P.L.C.

(57) ABSTRACT

A finger grip has a resilient tubular body which is adapted to be inserted into a finger hole of a bowling ball. The insert has a generally cylindrical inner wall surface with a pair of opposing gripping surfaces at each end of the insert. Thus, the insert provides four gripping members in a single insert.

12 Claims, 3 Drawing Sheets

BOWLING BALL FINGER GRIP

BACKGROUND AND SUMMARY OF THE INVENTION

The present invention relates to bowling balls, and more particularly, to a finger insert adapted to be inserted into a finger hole of a bowling ball to enhance the bowler's grip during delivery of the ball.

In bowling, it is the object of the bowler to knock down as many pins as possible. Many successful bowlers throw a ball which has a pronounced hook since, historically, this type of delivery generates the most pin action. To make a ball hook, it is necessary to maintain contact between the fingers and the ball during delivery to impart a "lifting" action on the ball.

Finger hole inserts are used by bowlers to augment the lift and spin imparted to the ball during release. Likewise, some finger hole inserts are designed to provide the bowler with greater control (i.e., "feel") of the ball. In general, finger inserts allow the bowler's fingertips to stay in contact with the ball while providing a desired function such as enhancing the feel or adding lift to the bowler's delivery.

Applicant has proposed several finger insert solutions. These inserts are illustrated in U.S. Pat. Nos. 5,002,276; 5,007,640; 5,123,644; 5,176,378; and 5,308,061. While these finger inserts work satisfactorily for their intended purpose, practitioners are always striving to improve the art.

Accordingly, it is an object of the present invention to provide a bowling ball finger insert which provides a dual purpose at each end of the insert. Thus, each insert provides four use positions. The insert has a tubular body with an outer and an inner wall. The inner wall surface extends substantially coaxial to a central axis of the outer wall surface. The body defines first and second finger openings at opposite terminal ends of the body which are adapted to receive a finger tip. A first finger gripping member is along the periphery of the inner wall surface adjacent the first finger opening. A second finger gripping member is along the periphery of the inner wall surface adjacent the first finger opening. The second finger gripping member directly opposes the first finger gripping member and is a different gripping member than the first finger gripping member. A third finger gripping member is along the periphery of the inner wall surface adjacent the second finger opening. A fourth finger gripping member is along the periphery of the inner wall surface adjacent the second finger opening. The fourth finger gripping member directly opposes the third finger gripping member and is a different gripping member than the third finger gripping member.

The present invention provides an injection molding finger insert which is economical to manufacture and is simple in construction. The finger inserts may be permanently or removably secured within the finger holes of the bowling ball so as to enable the user a choice of four finger gripping members.

From the following description, taken in conjunction with the accompanying drawings and subjoined claims, other objects and advantages will become apparent to those skilled in the art.

DETAILED DESCRIPTION OF THE PREFERRED EMBODIMENT

Figure 1:
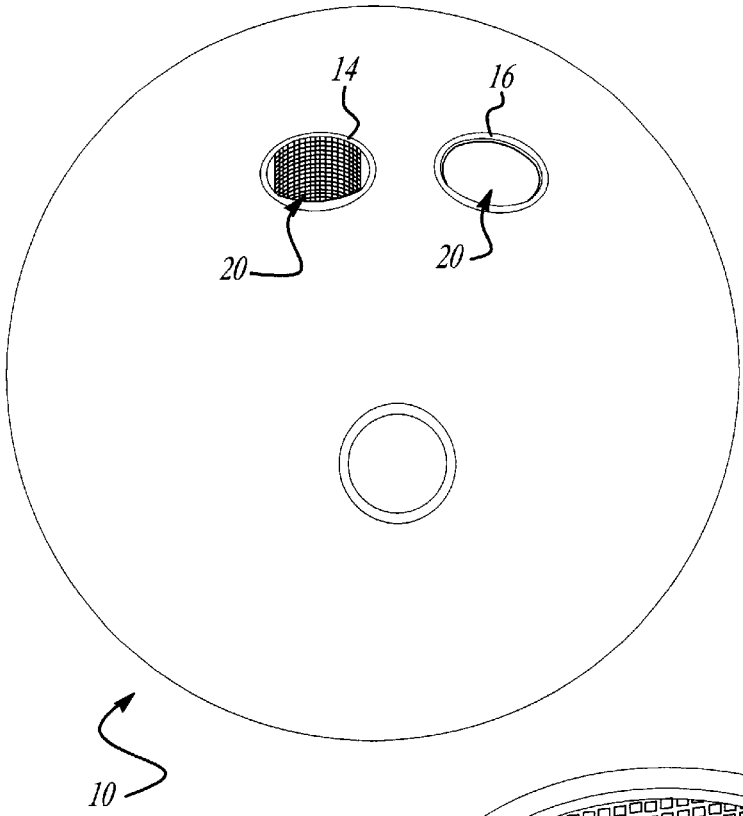
FIG. 1 is a plan view of a bowling ball incorporating finger inserts in accordance with the present invention.

Referring to the figures, particular FIG. 1, a bowling ball is illustrated and designated with the reference numeral 10. The bowling ball includes a thumb hole 12 and two finger holes 14 and 16. Finger inserts 20 are illustrated in the finger holes 14 and 16. The finger inserts 20 are secured in finger holes 14 and 16 so as to be substantially flush with the exterior of the bowling ball 10.

Figure 2:
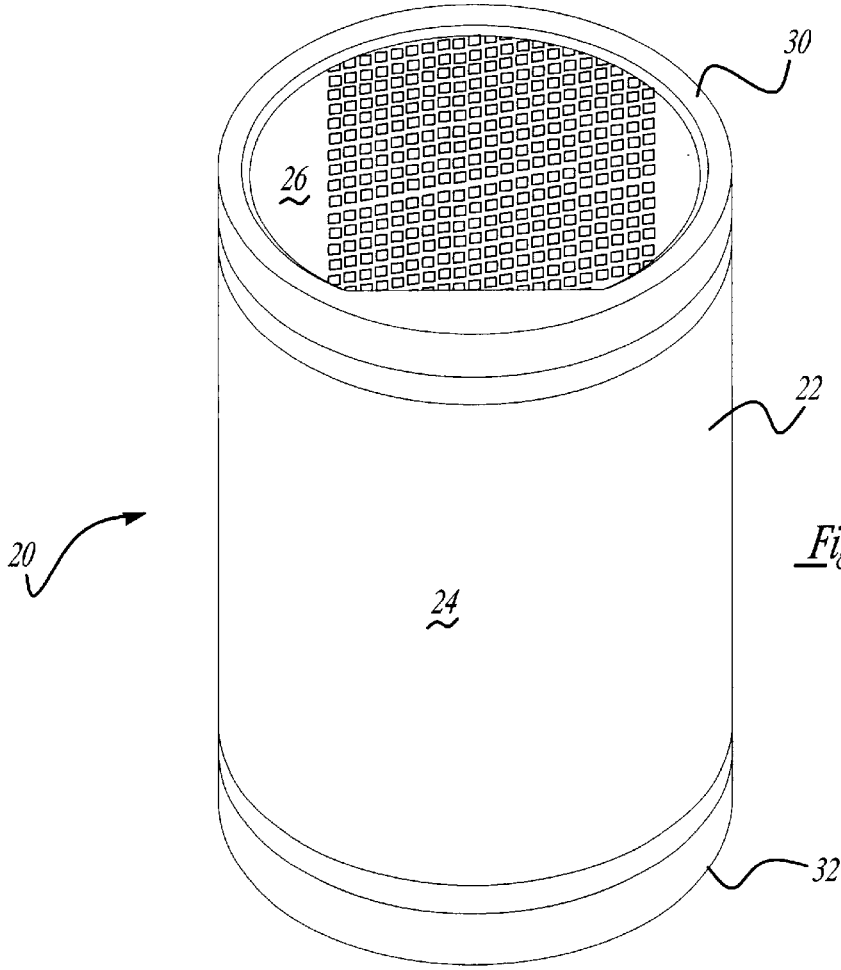
FIG. 2 is a perspective view of a finger insert in accordance with the present invention.
Figure 3:
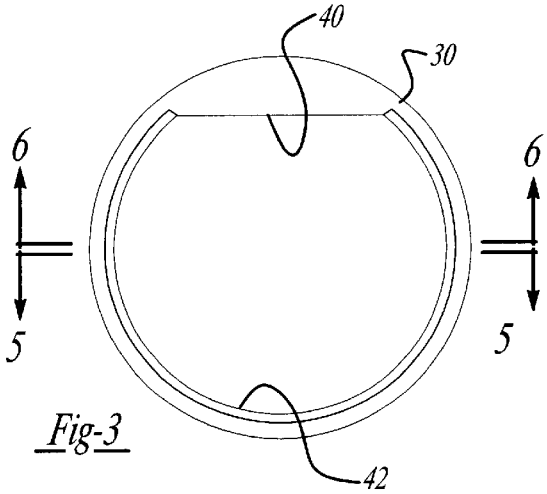
FIG. 3 is an end view of a first side of the finger insert of FIG. 2.
Figure 4:
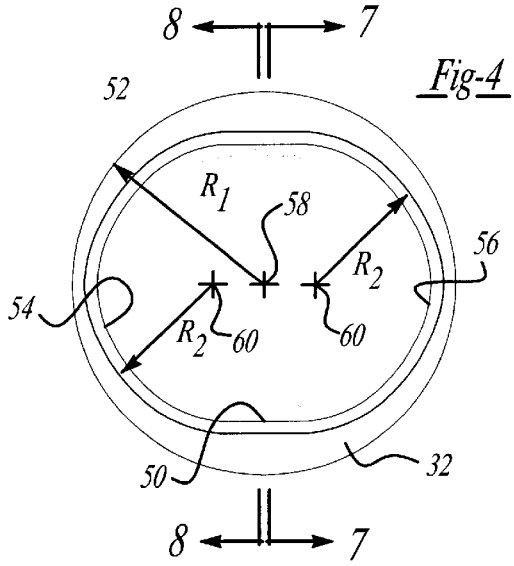
FIG. 4 is an end view of the second end of the finger insert of FIG. 2.
Figure 5:
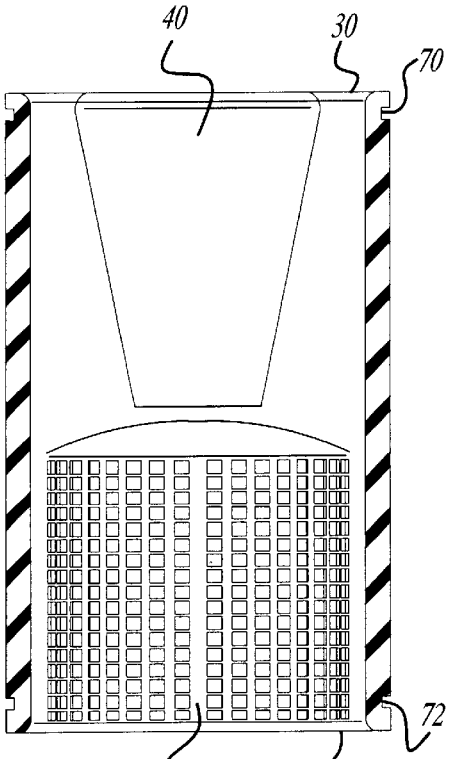
FIG. 5 is a cross-section view taken along line 5—5 of FIG. 3.
Figure 6:
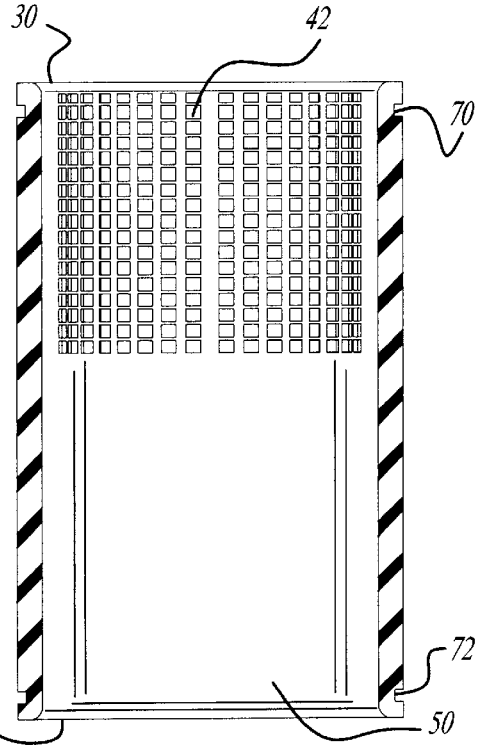
FIG. 6 is a cross-section view along line 6—6 of FIG. 3.
Figure 7:
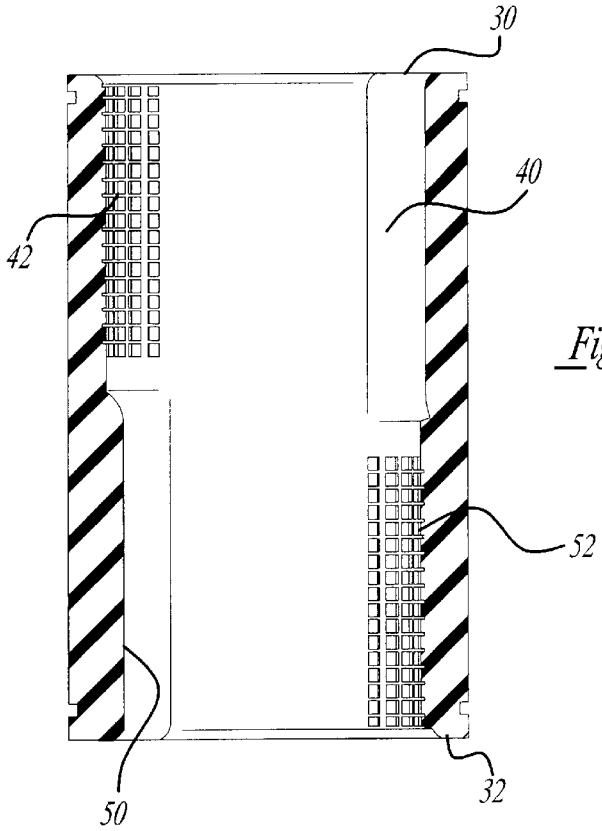
FIG. 7 is a cross-section view of FIG. 3 along line 7—7 thereof.
Figure 8:
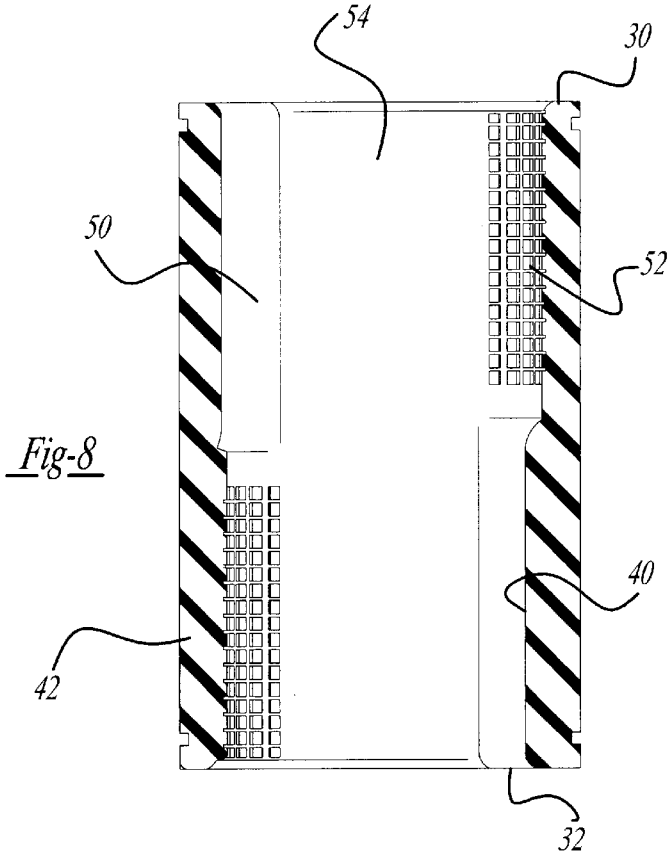
FIG. 8 is a cross-section view along line 8—8 of FIG. 1.

FIG. 2 illustrates a perspective view of the finger insert 20. Finger insert 20 includes an elongated tubular body which is in the shape of a right circular cylinder. Preferably, the finger insert 20 is an injection molded, right circular, hollow body fabricated from a relatively resilient material such as silicone, rubber or vinyl. However, it should be understood that any resilient material which provides suitable characteristics is within the scope of the invention.

The body 22 includes an outer surface 24 and an inner surface 26. The outer surface 24 defines a central axis 28. The inner surface of the body is substantially coaxial to the central axis of the outer wall surface 26. The body 22 defines two open ends 30 and 32. The open ends 30 and 32 enable access of the bowler's finger within the insert.

Referring to FIGS. 5–8, a better understanding of the insert may be had. The insert includes a first gripping surface 40 which is adjacent to the first open end 30. First gripping surface 40 is a thickened cushioning surface which defines a finger pad. Generally, the thickened surface increases in thickness from the inside of the tube towards the open end. The pad generally has a triangular shape with the apex of the triangle extending towards the second opening 32.

A second finger gripping member 42 is formed about the periphery of the inner surface substantially directly opposite the first finger gripping member 40. The second gripping member 42 is approximately one hundred twenty (120°) degrees about the periphery of the inner surface 24. Thus, a pair of smooth connecting portions 44 and 46 are between the two gripping members 40 and 42 on the inner periphery of the inner surface. The second gripping surface 42 may be a knurled or roughed surface to provide a different gripping surface for the user.

Thickened finger pads 50, 52 enhance the "feel" by providing increased contact area with the bowler's fingertip, while concomitantly guiding the release of the fingers from the finger insert. The thickened pads 50, 52 oppose one another to form a third and fourth gripping member. One of the pads 52 preferably has a roughed or knurled surface. Further, arcuate surfaces 54, 56 are positioned between finger pads 50, 52 and may act as finger pads. If these pads 54, 56 are used, finger pads 50, 52 are aligned to engage the lateral edges of the bowler's fingertip, thereby guiding the release of the fingertips from axial bore.

According to the embodiment shown, axial bore 52 has an oblong surface profile at end 32 which is substantially coaxial with outer wall surface 24 with respect to a central longitudinal axis 58 of finger insert 20. The wall portion formed between the inner wall surface of oblong bore and circular outer wall surface 24 has a variable cross-sectional thickness, particularly between thickened finger pad 50, 52 and arcuate finger pad 54, 56. As noted, outer wall surface 24 of finger insert 20 is preferably circular, as indicated by a radius $R_1$ having its origin on longitudinal axis 58. In addition, the inner wall surface of oblong bore is shown to include a pair of elongated arcuate wall surfaces each having a second radius $R_2$ with its respective origin aligned on a longitudinal axis that is parallel to and laterally offset from longitudinal axis 58. Moreover, the laterally-spaced terminal ends of elongated arcuate walls are interconnected by a pair of elongated planar wall surfaces. Thus, adjacent finger opening 32, a pair of arcuate finger pads 54, 56 are defined by arcuate wall surfaces while a pair of thickened planar finger pads are defined by planar wall surfaces. As best seen from the cross-sectional views shown in FIGS. 5–8, elongated arcuate wall surfaces and planar wall surfaces extend halfway across the length of axial bore in finger insert.

According to the preferred embodiment shown, the longitudinal axis 60 for each arcuate wall surface is equally offset along a transverse plane with respect to longitudinal axis 58. Preferably, the second radius $R_2$ for each of arcuate wall surfaces is identical and extends 180° for defining semi-cylindrical wall surfaces. As such, planar wall surfaces are adapted to extend parallel to transverse plane as well as to each other. However, it will be appreciated that each arcuate wall surface may have a different second radius $R_2$, differing amounts of offset from longitudinal axis and/or varying angular chord lengths to produce finger inserts having arcuate finger pads and thickened finger pads that are configured differently than the symmetrical arrangement disclosed.

The outer surface of the insert includes a pair of grooves 70, 72. The grooves are positioned adjacent ends 30 and 32. The grooves 70, 72 receive excess glue that may be placed in the finger hole when the insert is secured to the ball. Thus, glue does not escape to the outer surface of the ball.

The outside diameter of the finger insert is preferably uniform regardless of the bowler's finger size so that the finger insert 20 may be fit interchangeably in a standardized finger hole 14, 16. More specifically, most bowling balls are currently provided with finger holes of approximately 31/32" in diameter and drilled to a depth of about 1⅛" to 1⅜". By maintaining a uniform outside diameter of the insert, the size of the finger holes can be standardized thereby minimizing problems associated with drilling finger holes.

The finger insert is preferably available in a set of several different sizes of the bore corresponding to preselected finger sizes. More preferably, the bore is available in increasing increments of about 1/32" from about 19/32" to about 29/32". Incremental changes in finger sizes are compensated for by increasing the constant wall thickness defined between the outer wall surface and the inner wall surface. In this manner, regardless of size, the thickness of the finger pad relative to the inner wall surface is uniform for all inserts. It is to be understood that the insert of the present invention can be fabricated to any desired length or any bore diameter which is required to meet the demands of bowlers.

The inserts, which include the four different types of finger members, provide a function which enhances the feel for the bowler. The different finger grips may enhance feel or lift or may enhance gripping. In this manner, it enables the bowler to increase his hook to generate increased pin action.

The finger grips of the present invention are reversible so that the first end or second end may be flush with the outside of the bowling ball. Also, the finger grip may be rotated so that one of the four finger inserts may be contacted by the bowler. Further, the bowler may desire to have a different finger gripping member on each of the two holes so that the bowler may experience a different pad on each finger.

Preferably, the insert is made of an elastomeric and resilient material which can be secured within the finger holes provided in a bowling ball. It is contemplated that the insert may be permanently secured within the finger hole or may be removably secured therein by any method and materials known to those skilled in the art. Likewise, the insert material should provide a predetermined level of compressibility and deformability to provide comfortable, secure reception of a bowler's finger tips without the risk of "hang-up" upon release of the ball.

While the above detailed description describes the preferred embodiment of the present invention, the invention is susceptible to modification, variation, and alteration without deviating from the scope and fair meaning of the subjoined claims.

What is claimed is:

1. A bowling ball insert comprising:

a tubular body having an outer wall surface adapted to be inserted into a finger hole of a bowling ball;

said body having an inner wall surface extending substantially coaxial to a central axis of said outer wall surface and said body defining first and second finger openings at opposite terminal ends of said body which are adapted to receive a finger tip;

a first finger gripping member along the periphery of said inner wall surface adjacent said first finger opening;

a second finger gripping member along the periphery of said inner wall surface, adjacent said first finger opening, said second finger gripping member directly opposing said first finger gripping member and having a surface texture different than said first finger gripping member;

a third finger gripping member along the periphery of said inner wall surface adjacent said second finger opening; and a fourth finger gripping member along the periphery of said inner wall surface adjacent said second finger opening, said fourth finger gripping member directly opposing said third gripping member and having a surface texture different than said third finger gripping member;

wherein said insert has four effective functions depending on the orientation of said insert.

2. The bowling ball insert according to claim 1, wherein said first, second, third and fourth finger gripping members extending over a portion of the periphery of the inner wall surface.

3. The bowling ball insert according to claim 2, wherein a portion of said inner wall surface between said first and second and third and fourth gripping member being arcuate.

4. The bowling ball insert according to claim 1, wherein said first gripping member is a thickened finger pad and said second gripping member being a textured surface.

5. The bowling ball insert according to claim 1, wherein said third gripping member being a smooth surface defined by a radius smaller than said tubular body radius and said fourth gripping member being a textured surface defined by a radius smaller than the radius of said tubular body.

6. The bowling ball insert according to claim 1, wherein said first and third and second and fourth finger gripping members abutting one another along the central axis.

7. A bowling ball assembly, comprising:

a bowling ball having at least one finger hole;

a resilient insert disposed within said finger hole;

said insert having an inner wall surface extending substantially coaxial to a central axis of said outer wall surface and said body defining first and second finger openings at opposite terminal ends of said body which are adapted to receive a finger tip;

a first finger gripping member along the periphery of said inner wall surface adjacent said first finger opening;

a second finger gripping member along the periphery of said inner wall surface adjacent said first finger opening, said second finger gripping member directly opposing said first finger gripping member and being a different gripping member with a different surface texture from said first gripping member;

a third finger gripping member along the periphery of said inner wall surface adjacent said second finger opening; and a fourth finger gripping member along the periphery of said inner wall surface adjacent said second finger opening, said fourth finger gripping member directly opposing said third finger gripping member and being a different gripping member with a different surface texture from said third gripping member;

wherein said insert may be disposed in said finger hole with said insert first or second finger opening adjacent an external surface of said bowling ball and said first, second, third or fourth gripping member to be contacted by the bowler's finger tip.

8. The bowling ball assembly according to claim 7, wherein said first, second, third and fourth finger gripping members extending over a portion of the periphery of the inner wall surface.

9. The bowling ball insert according to claim 8, wherein a portion of said inner wall surface between said first and second and third and fourth gripping member being arcuate.

10. The bowling ball insert according to claim 7, wherein said first gripping member is a thickened finger pad and said second gripping member being a textured surface.

11. The bowling ball insert according to claim 7, wherein said third gripping member being a smooth surface defined by a radius smaller than said tubular body radius and said fourth gripping member being a textured surface defined by a radius smaller than the radius of said tubular body.

12. The bowling ball insert according to claim 7, wherein said first and third and second and fourth finger gripping members abutting one another along the central axis.

* * * * *